US006766792B2

(12) United States Patent
Messinger et al.

(10) Patent No.: US 6,766,792 B2
(45) Date of Patent: Jul. 27, 2004

(54) ENGINE COMPONENT ACTUATION MODULE

(75) Inventors: Delos D. Messinger, Bloomington, IL (US); Scott F. Shafer, Morton, IL (US); Alan R. Stockner, Metamora, IL (US)

(73) Assignee: Caterpillar Inc, Peoria, IL (US)

( * ) Notice: Subject to any disclaimer, the term of this patent is extended or adjusted under 35 U.S.C. 154(b) by 15 days.

(21) Appl. No.: 10/323,701

(22) Filed: Dec. 18, 2002

(65) Prior Publication Data

US 2004/0118380 A1 Jun. 24, 2004

(51) Int. Cl.[7] ..... F02M 37/04
(52) U.S. Cl. ..... 123/502; 123/446; 123/90.12
(58) Field of Search ..... 123/502, 508, 123/456, 446, 90.12, 90.13, 193.5, 193.3, 196 M, 196 DA

(56) References Cited

U.S. PATENT DOCUMENTS 4,455,985 A 6/1984 Asayama
5,237,976 A 8/1993 Lawrence et al.
5,636,602 A * 6/1997 Meister ..... 123/90.12
5,638,791 A 6/1997 Tsuzuki et al.
6,148,778 A * 11/2000 Sturman ..... 123/90.12
6,173,685 B1 1/2001 Sturman
6,250,285 B1 6/2001 Takase
6,360,728 B1 * 3/2002 Sturman ..... 123/508
6,405,707 B1 * 6/2002 Feucht ..... 123/321
6,560,867 B2 * 5/2003 Stretch ..... 29/888.01

* cited by examiner

*Primary Examiner*—Mahmoud Gimie
(74) *Attorney, Agent, or Firm*—Thomas L Derry

(57) ABSTRACT

The present invention relates to a module for actuating fuel injectors and valves an internal combustion engine. The actuation module includes a housing having a high pressure rail and a low pressure rail. A plurality of actuation pistons are disposed in the housing and engage fuel injectors and intake/exhaust valves of the engine. One or more actuating valve assemblies control the flow of hydraulic fluid from the high pressure rail each of the actuation pistons.

17 Claims, 3 Drawing Sheets

ENGINE COMPONENT ACTUATION MODULE

TECHNICAL FIELD

The present invention relates generally to an internal combustion engine, and more specifically to a component actuation module having a fuel injection actuator, a valve actuator and a high pressure fuel components.

BACKGROUND

In conventional internal combustion engines, engine combustion valve opening and closing events are sequenced and driven by a camshaft and valve train. Such valves are typically spring biased toward a closed position and opened against the spring by a lobe on the rotating camshaft. The camshaft is synchronized with the engine crankshaft to achieve valve opening and closing at preferred times in the combustion cycle. This synchronization, or timing, is a compromise between the timing best suited for high engine speed and the timing best suited for lower engine speeds.

Fuel for such engines is often introduced into the combustion chamber using a fuel injector where the fuel mixes with intake air. Many fuel injectors and engine valves are connected through actuator various members to a cam. This connection is normally made through openings in the cylinder head. The cylinder head in-turn, covers the cylinder of the engine and is normally a unitary structure. The fuel injector and engine valve associated with each combustion chamber are connected to the cylinder head and extend into the chamber. These injector and valve actuating components are costly to manufacture and assemble.

One type of fuel injector, a hydraulically actuated electronically controlled fuel injector, is manufactured by the assignee of the present invention. The hydraulically actuated injector includes an intensifier piston that pressurizes fuel within the injector to an extremely high pressure during the injection cycle. A control valve permits high-pressure oil to controllably act on the intensifier piston of the injector. The hydraulic pressure oil, typically engine-lubricating oil acts on the injector. After the injection cycle is complete, spent oil drains from the intensifier portion of the injector drains back to an engine sump. Viscosity of the oil is highly susceptible to temperature, extreme temperatures may adversely impact control of the injection cycle. Another potential problem with using engine oil for hydraulic actuation is component wear. Contaminants in the lubricating oil may induce wear or sticking of the injector. Injector components have precise tolerances and may be highly susceptible to abrasion, it would be advantageous to actuate injectors using high quality hydraulic oil.

U.S. Pat. No. 5,237,976, issued Aug. 24, 1993 to Keith E. Lawrence discloses an engine having hydraulically actuated engine valves. An actuator housing is positioned above the cylinder head. The actuator housing includes hydraulically actuated pistons (or actuators), hydraulic rails and control valves. The actuators are electronically controlled to operate the engine valves. An injector portion of the housing controls the flow of high pressure lubricating oil to an intensifier piston positioned in the fuel injector. After the injection cycle, lubricant spills into the cylinder head and returns to the engine oil sump. The actuation module as disclosed by Lawrence reference must be assembled onto an engine for functional testing. It would be preferable, to provide an actuation module operating on a hydraulic fluid source separate from lubricating oil and being capable of testing prior to assembly on the engine.

The present invention is directed to overcoming one or more of the above identified problems.

SUMMARY OF THE INVENTION

An actuation module for use with an internal combustion engine is provided. The module includes a housing connectable to a cylinder head of an engine. At least one intensifier piston is disposed in a cavity of the module and movable between a first position and a second position. Movement toward the second position causes pressurization of fuel in a injector and an actuating valve assembly connectable to said housing directs hydraulic fluid from a hydraulic pump to the intensifier piston.

Another embodiment of the present invention provides an internal combustion engine having an engine block having a plurality combustion cylinders. A cylinder head is attached to the engine block and includes a fuel injector positioned therein. An actuation module having a piston cavity and being connectable to the cylinder head and an intensifier piston is moveably disposed within said piston cavity. Movement of said intensifier piston causes pressurization of a fuel in the fuel injector.

Another embodiment of the present invention provides an actuation module for use with an internal combustion engine. The module is connectable to a cylinder head of the engine. An intensifier piston is disposed in the housing and movable between a first and a second position. An actuating valve assembly is configured to direct hydraulic fluid to the intensifier piston causing movement of the piston, which in-turn causes pressurization of a fuel in a fuel injector. A dedicated hydraulic system provides hydraulic fluid to the actuating valve assembly.

DETAILED DESCRIPTION

Figure 1:
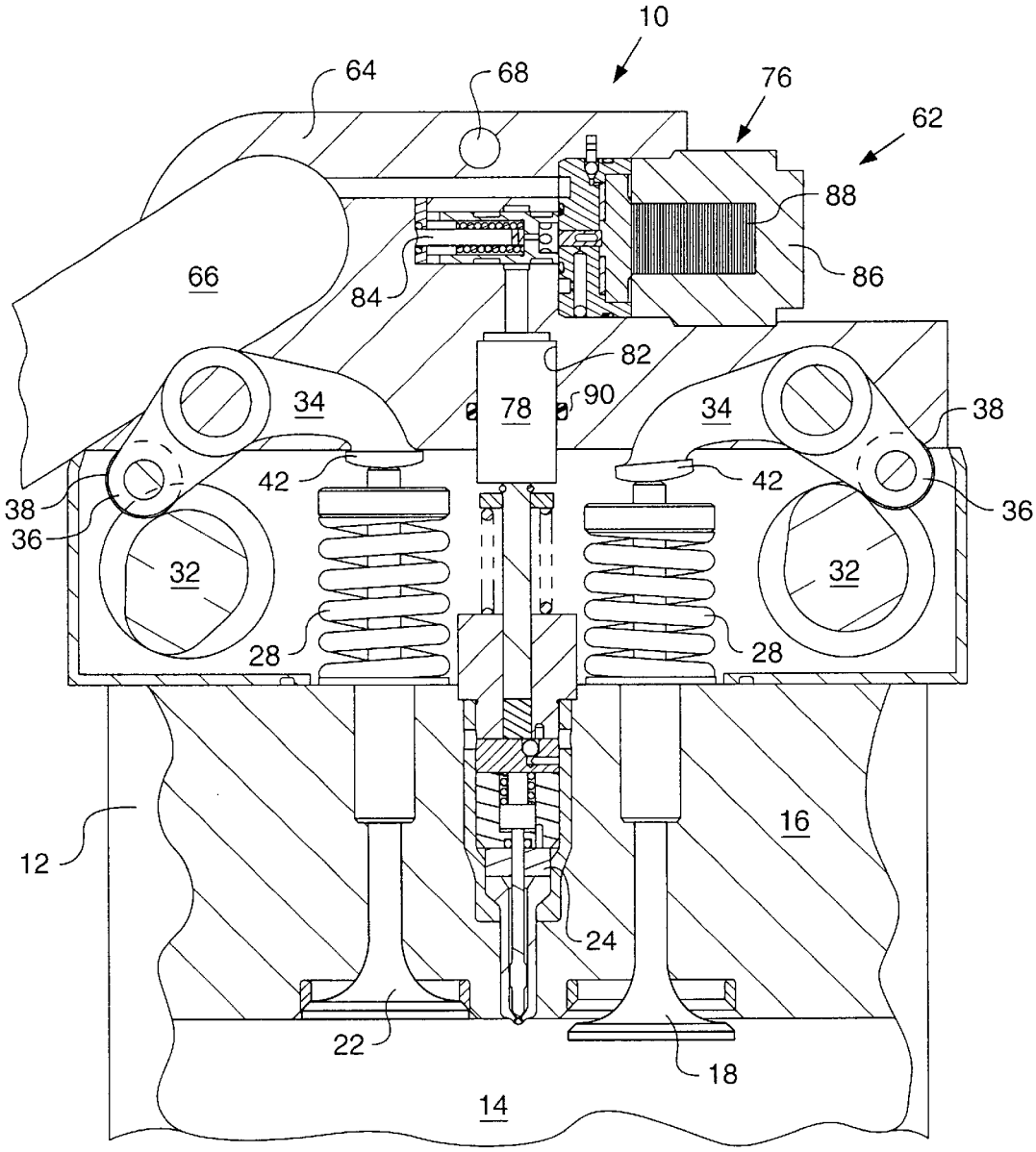
FIG. 1 is a fragmentary sectional view of one embodiment of the present invention positioned on an internal combustion engine.

Referring to FIG. 1, an embodiment of an internal combustion engine 10 employing the present invention is shown. A fragmentary cross sectional view of one cylinder of the internal combustion engine 10 is illustrated. The engine 10 includes a block 12 having combustion cylinders 14 (one shown). The combustion cylinder 14 is adapted to reciprocally receive a piston (not shown). At the top of the combustion cylinder 14, a cylinder head 16 is fastened in a typical manner. The cylinder head 16 includes an intake valve 18, an exhaust valve 22 and a fuel injector 24. The intake and exhaust valves 18, 22 each include a valve spring 26 positioned and retained about a valve stem 28. The spring 26 is adapted to bias its respective valve 18, 22 to a closed position. The cylinder head 16 further includes a pair of camshafts 32 that are connected to a crankshaft (not shown) in a conventional manner. A rocker arm 34 is pivotally positioned between one of the camshafts 32 and a respective one of the intake or exhaust valves 18, 22. The rocker arm 34 includes a first end 36 having a roller 38 that rides on the camshaft 32, and a second end 42 that mechanically actuates the valve 18, 22. It should be noted that more than one intake or exhaust valve 18, 22 could be provided for each combustion cylinder 14, without deviating from the present invention. The fuel injector 24, as illustrated, is a hydraulically actuated electronically controlled fuel injector 24.

The engine 10 includes a lubrication system 44 in a typical fashion. The lubrication system includes a lubrication pump 46 having an inlet 48 and an outlet 50. The engine 10 drives the pump 46. The outlet 50 of the lubrication pump 44 is connected to a plurality of conduits and passages 52. Lubricating oil 54 in an engine sump 56 is picked up by the pump 46 and pressurized to flow through the conduits and passages 52, lubricating various mechanical components. Typically, after lubricating the various mechanical components, the oil 54 drains back to the engine sump 56 through a plurality of drain passages 58 in the engine.

Figure 3:
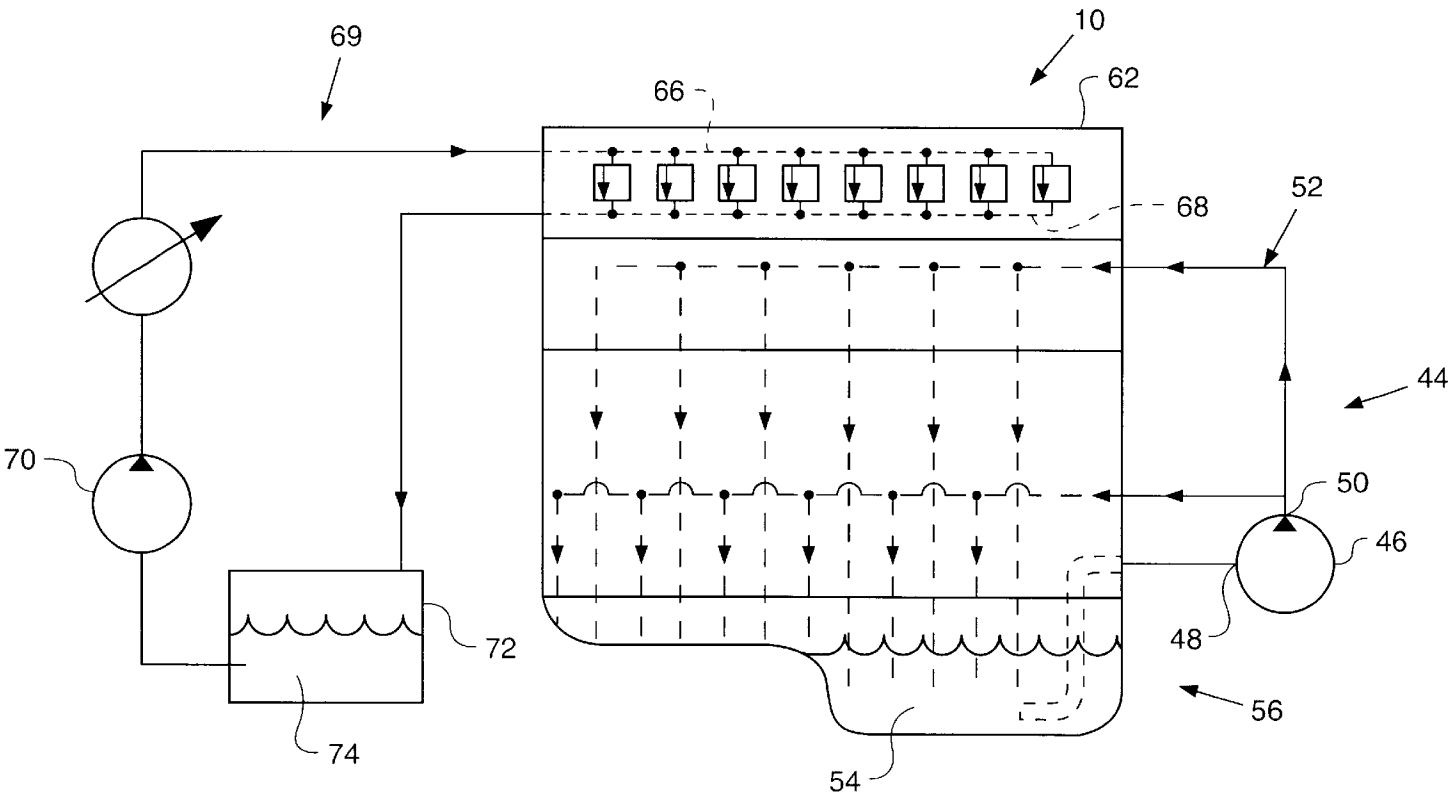
FIG. 3 is a schematic representation of the hydraulic and lubrication systems of an engine utilizing the present invention.

An actuation module 62 is positioned on the cylinder head 16, functioning in part as a valve cover. The actuation module 62 includes a housing 64, a high pressure fluid supply rail 66 and a low pressure return rail 68. The high pressure supply rail 66 is connected to a hydraulic system 69 having hydraulic pump 70. (The hydraulic system is illustrated in FIG. 3.) The hydraulic pump 70 is connected to a hydraulic sump 72 containing a hydraulic fluid 74. The hydraulic system 69 may be configured to use hydraulic fluid 74 from an existing machine system such as, a transmission or power steering system, or may use a dedicated hydraulic fluid 74. It is desirable to use a hydraulic fluid 74 that resists viscosity changes caused by temperature extremes. Although less desirable, the pump 70 may be connected to the engine lubricating oil sump 56. An actuating valve assembly 76 is further positioned within the actuating module 62. The actuating valve assembly 76 is operably positioned between the high and low pressure rails 66, 68 and an intensifier piston 78. The intensifier piston 78 is positioned in a piston cavity 80 and engages the fuel injector 24.

The actuating valve assembly 76 is moveable between a first position and a second position. In the first position, the actuating valve assembly 76 is configured to direct the high pressure fluid 74 from the high pressure rail 66 to the piston cavity 82, causing movement of the intensifier piston 78. In the second position, flow from the high pressure rail 66 to the intensifier piston 82 is blocked, and fluid 74 in the piston cavity 82 is permitted to flow to the low pressure rail 68. As the fluid 74 in the piston cavity 82 drains, the piston 82 is urged into the piston cavity 82 by the fuel injector 24. The actuating valve assembly 76 includes a valve portion 84 and an actuator portion 86, such as a piezoelectric motor 88. The piezoelectric motor 88, which is well known in the art expands linearly upon electrical excitement. The actuator portion 86 includes an electrical connector (not shown) to permit electronically coupling the actuator portion 86 to an electronic control module (not shown). It should be noted that numerous alternative actuator portions 86 may be used, including a solenoid, voice coil or liner motor.

The intensifier piston 78 is adapted to pressurize fuel the fuel injector 24. A seal 90 is positioned between the piston cavity 82 and the intensifier piston 78. The seal 90 is configured prevent hydraulic fluid 74 in the piston cavity 82 from co-mingling with engine lubricating oil 54.

Figure 2:
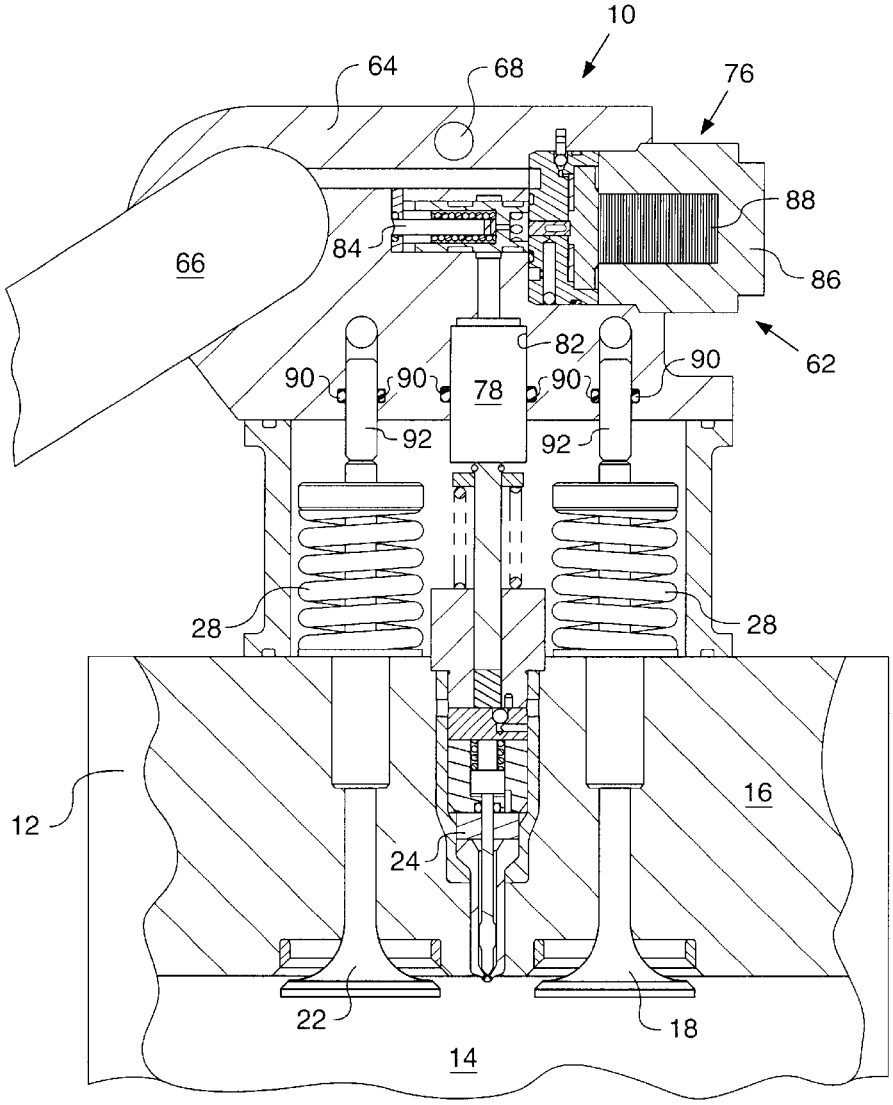
FIG. 2 is a fragmentary sectional view of another embodiment of the present invention positioned on the internal combustion engine.

Referring now to FIG. 2, another embodiment of the present invention is shown. Similar to the prior embodiment, a fragmentary view of an internal combustion engine 10 is illustrated. The actuation module 62 also includes an actuator housing 64, high pressure supply rail 66 and a low pressure return rail 68 are provided, as previously described. The intensifier piston 78 and actuating valve assembly 76 are also included.

Alternatively of the prior embodiment, the intake valve 18 and exhaust valve 22 of the engine 10 each engage an actuating piston 92 positioned in the actuation module 62. The valve actuating pistons 92 are configured substantially similar to the intensifier piston 78. An intake actuator valve assembly 94 and an exhaust actuator valve assembly 96 are positioned in the actuator housing 64. The intake and exhaust valve actuator assemblies 92, 94 and control the flow of hydraulic fluid 74 from the high pressure rail 66 to the respective actuator piston 92, similar to the fuel injection actuating valve assemblies 76. Each of the actuating pistons 92 includes a seal 90 to isolate hydraulic fluid 74 from lubricating oil 54. The intake and exhaust actuating pistons 92 are configured to operably engage the intake and exhaust valves 18, 22 of the engine 10. The electronic controller functions to actuate each of the intensifier, intake and exhaust pistons 78, 92, providing optimum valve and fuel injector timing for a specific engine speed.

The previous description has been limited to an actuator module for a single cylinder of an engine. It should be noted that the actuator module constructed to operate multiple cylinder engines by fluidly coupling the high and low pressure rails of a plurality of single cylinder units together. Alternatively, a single housing may be constructed to fit a multiple cylinder engine 10 and include multiple intake, exhaust and fuel injector pistons 78, 92.

Referring back to FIG. 3, a schematic illustration of an engine 10 lubricating system 44 and a hydraulic system 69 for supplying high pressure hydraulic fluid 74 to the actuation module 62 is shown. The engine lubricating system 44 includes an engine sump 56 and a lubrication pump 46 having in inlet 48 and an outlet 50. The inlet is fluidly coupled to the engine sump 56 and the outlet 50 is fluidly coupled to a plurality of conduits and passages 52. Pressurized lubricating oil 54 flows from the pump 46 to engine components and drains back to the engine sump 56 through the plurality of drain passages 58.

The hydraulic system 69 includes a dedicated sump 72 and a hydraulic pump 70. The hydraulic pump 70 draws hydraulic fluid 74 from the sump 72 and pressurizes high pressure rail 66 of the actuation module 62. Actuating valve assemblies 76 of the module 62 control hydraulic fluid 74 flow to the intensifier, intake and exhaust pistons 72, 92. Spent hydraulic fluid 74 from the pistons 78, 92 returns to the sump 72 through the low pressure rail 68.

INDUSTRIAL APPLICABILITY

In operation the present invention is attached to the cylinder head 16 of the internal combustion engine 10. The electronic controller monitors operating parameters of the engine 10, and controls the actuating pistons 78,92 through the actuation module 62 to optimize performance of the engine 10.

The integral actuation module using hydraulic fluid 74 provides for simplified assembly and installation on the engine 10. The integrated actuation module 62 eliminates wear problems due to dirty oil. After manufacture and assembly of the module 62, a simple bench test can be performed using a dedicated test electronic controller, high pressure oil supply and a test sump. The module 62 is connected to the test supply and sump and controller, the controller runs a test sequence and operation of the actuators can be visually observed. It may also be desirable to measure the force of actuating pistons 78, 92 during the test cycle.

What is claimed is:

1. An actuation module for use with an internal combustion engine comprising:

a housing having at least one piston cavity and being connectable to a cylinder head of an engine;

an at least one intensifier piston being disposed is said cavity and reciprocatably movable between a first position and a second position, wherein moving to the second position causes pressurization of a fuel in an at least one fuel injector; and an actuating valve assembly connectable to said housing and being configured to direct hydraulic fluid from a hydraulic pump to said intensifier cavity piston, causing movement of said intensifier piston.

2. The actuation module of claim 1, including multiple piston cavities and intensifier pistons disposed in said module, each of said intensifier pistons associated with a respective one of a plurality of fuel injectors.

3. The actuating module of claim 1, including a seal positioned between said piston cavity and said intensifier piston, wherein said seal is configured to prevent co-mingling of said hydraulic fluid with an engine lubricating oil.

4. The actuating module of claim 1, including a high pressure rail disposed within said housing, said high pressure rail being configured to direct said hydraulic fluid from a hydraulic pump to said actuating valve assembly.

5. The actuating module of claim 1, wherein said hydraulic fluid source is a dedicated hydraulic fluid system.

6. The actuating module of claim 1, wherein said hydraulic fluid source is a power steering system.

7. The actuating module of claim 1, wherein said hydraulic fluid is transmission fluid.

8. The actuating module of claim 1, including at least one of an intake and exhaust actuator piston, wherein said at least one actuator piston is configured to operate a respective one of an intake valve and an exhaust valve of an engine.

9. An internal combustion engine comprising:

an engine block having a plurality pistons reciprocally positioned with a combustion cylinder;

a cylinder head attached to said engine block, said cylinder head having at least one intake valve, at least one exhaust valve and a fuel injector positioned therein; and an actuation module having a piston cavity and being connectable to said cylinder head, wherein an intensifier piston is moveably disposed within said piston cavity and being movable between a first and second position, wherein movement of said intensifier piston toward the second position causes pressurization of a fuel in said fuel injector, and an actuating valve assembly configured to direct fluid from a hydraulic pump to said intensifier piston.

10. The engine of claim 9, including a fluid seal being positioned between said piston cavity and said intensifier piston, wherein said seal is configured to prevent co-mingling of hydraulic fluid and engine lubricating oil.

11. The engine of claim 9, including a high pressure rail disposed within said housing, said high pressure rail being configured to direct said hydraulic fluid from a hydraulic pump to said actuating valve assembly.

12. The engine of claim 9, wherein said hydraulic fluid source is a dedicated hydraulic system.

13. The engine of claim 9, wherein said hydraulic fluid is a power steering system.

14. The engine of claim 9, wherein said hydraulic is a transmission fluid.

15. The engine of claim 9, including at least on of an intake and an exhaust actuator piston, wherein said at least one actuator piston is configured to operate a respective one of said intake and exhaust valves of said engine.

16. An actuation module for use with an internal combustion engine comprising:

a module housing having a piston cavity and being connectable to a cylinder head of an engine;

an intensifier piston disposed in said piston cavity and being movable between a first and a second position;

an actuating valve assembly being configured to direct hydraulic fluid to said intensifier piston causing movement of said piston, wherein movement of said intensifier piston toward the second position causes pressurization of a fuel in a fuel injector; and a dedicated hydraulic system including a pump and a sump fluidly coupled to a high pressure rail, wherein said hydraulic system provides hydraulic fluid to said actuating valve assembly.

17. The actuation module of claim 16, having a plurality of piston cavities and intensifier pistons disposed within said module, each of said intensifier pistons being associated with a respective one of a plurality of fuel injectors for pressurizing a fuel within said fuel injector.

* * * * *

UNITED STATES PATENT AND TRADEMARK OFFICE

CERTIFICATE OF CORRECTION

PATENT NO. : 6,766,792 B2
DATED : July 27, 2004
INVENTOR(S) : Delos D. Messinger et al.

It is certified that error appears in the above-identified patent and that said Letters Patent is hereby corrected as shown below:

Column 5,
Line 11, insert -- cavity -- after "piston"

Signed and Sealed this

Twelfth Day of October, 2004

JON W. DUDAS
*Director of the United States Patent and Trademark Office*